US008064813B2

(12) United States Patent
Fromm et al.

(10) Patent No.: US 8,064,813 B2
(45) Date of Patent: Nov. 22, 2011

(54) FUSER APPARATUS HAVING FUSER CLEANER WEB AND CORRESPONDING METHODS

(75) Inventors: Paul M. Fromm, Rochester, NY (US); Michele Cleary, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 475 days.

(21) Appl. No.: 12/251,658

(22) Filed: Oct. 15, 2008

(65) Prior Publication Data

US 2010/0092219 A1 Apr. 15, 2010

(51) Int. Cl.
*G03G 15/20* (2006.01)

(52) U.S. Cl. ..... 399/327; 399/71

(58) Field of Classification Search ..... 399/327, 399/320, 67, 71; 15/256.5, 256.51, 256.52
See application file for complete search history.

(56) References Cited

U.S. PATENT DOCUMENTS 5,049,944 A * 9/1991 DeBolt et al. ..... 399/325
5,749,038 A 5/1998 Fromm et al.
6,505,832 B2 1/2003 Moore et al.
6,876,832 B2 4/2005 Pirwitz et al.
7,177,585 B2 2/2007 Matsuzaka et al.
2002/0098019 A1* 7/2002 Rasch et al. ..... 399/324
2002/0154926 A1* 10/2002 Katoh ..... 399/327
2005/0175379 A1* 8/2005 Berg et al. ..... 399/325
2006/0072945 A1* 4/2006 Ide ..... 399/327
2008/0138103 A1* 6/2008 Nakano ..... 399/71
2009/0123185 A1* 5/2009 Lin et al. ..... 399/327 X
2009/0297186 A1* 12/2009 Fromm ..... 399/327 X

* cited by examiner

*Primary Examiner* — Sophia S Chen
(74) *Attorney, Agent, or Firm* — Ronald E. Prass, Jr.; Prass LLP

(57) ABSTRACT

Disclosed are methods of controlling a speed of a fuser cleaner web in a fuser apparatus, and the corresponding fuser apparatus. The method utilizes a fuser cleaner web for cleaning a fuser roll and being disposed between the fuser roll and a web nip roll, the fuser cleaner web being unwound from a web supply roll and wound onto a take up roll, the take up roll being driven by a motor. The method determines an angular displacement of the motor from a start of the fuser cleaner web being unwound from the web supply roll, and controls a speed of the motor to maintain a substantially constant fuser cleaner web speed, wherein the speed of the motor is controlled based on the determined angular displacement of the motor and a changing diameter of the take up roll.

20 Claims, 4 Drawing Sheets

FUSER APPARATUS HAVING FUSER CLEANER WEB AND CORRESPONDING METHODS

BACKGROUND

Disclosed are fuser apparatus having a fuser cleaner web and corresponding methods.

In a typical electrophotographic or electrostatographic printing process, a photoconductive member is charged to a substantially uniform potential so as to sensitize the surface thereof. The charged portion of the photoconductive member is exposed to selectively dissipate the charges thereon in the irradiated areas. This records an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules either to a donor roller or to a latent image on the photoconductive member. The toner attracted to a donor roller is then deposited as latent electrostatic images on a charge retentive surface which is usually a photoreceptor. The toner powder image is then transferred from the photoconductive member to a copy substrate. The toner particles are heated to permanently affix the powder image to the copy substrate.

In order to fix or fuse the toner material onto a support member permanently by heat and pressure, it is necessary to elevate the temperature of the toner material to a point at which constituents of the toner material coalesce and become tacky. This action causes the toner to flow to some extent onto the fibers or pores of the support members or otherwise upon the surfaces thereof. Thereafter, as the toner material cools, solidification of the toner material occurs causing the toner material to be bonded firmly to the support member.

One approach to thermal fusing of toner material images onto the supporting substrate has been to pass the substrate with the unfused toner images thereon between a pair of opposed rolls at least one of which is internally heated. During operation of a fusing system of this type, the support member to which the toner images are electrostatically adhered is moved through the nip formed between the rolls with the toner image contacting the heated fuser roll to thereby affect heating of the toner images within the nip. In a conventional two roll fuser, one of the rolls is typically provided with a layer or layers that are deformable by a harder opposing roller when the two rollers are pressure engaged.

In typical fusing systems, the fuser roll can be cleaned by a web. The web provides a textured surface for removing particles of toner that remained on the fuser roll after the paper with the toner image has passed through the fuser. The web may be drawn from a replaceable supply roll and be moved at a relatively slow rate relative to the movement of the fuser roll. The motion of the fuser roll relative to the web causes the fuser roll to rub against a small area of the web. Because the web is moving slower than the fuser roll friction of the web to the fuser roll surface causes a supply of clean web at a reasonable rate to clean toner from the fuser roll. Ideally, the web would be typically run at a substantially constant speed high enough to clean the fuser roll.

SUMMARY

According to aspects of the embodiments, there are provided methods of controlling a speed of a fuser cleaner web in a fuser apparatus, and the corresponding fuser apparatus. The method utilizes a fuser cleaner web for cleaning a fuser roll and being disposed between the fuser roll and a web nip roll, the fuser cleaner web being unwound from a web supply roll and wound onto a take up roll, the take up roll being driven by a motor. The method determines an angular displacement of the motor from a start of the fuser cleaner web being unwound from the web supply roll, and controls a speed of the motor to maintain a substantially constant fuser cleaner web speed, wherein the speed of the motor is controlled to maintain a substantially constant fuser cleaner web speed based on the determined angular displacement of the motor and a changing diameter of the take up roll, the changing diameter of the take up roll including a diameter of the fuser cleaner web as it is wound onto the take up roll.

DETAILED DESCRIPTION

Figure 1:
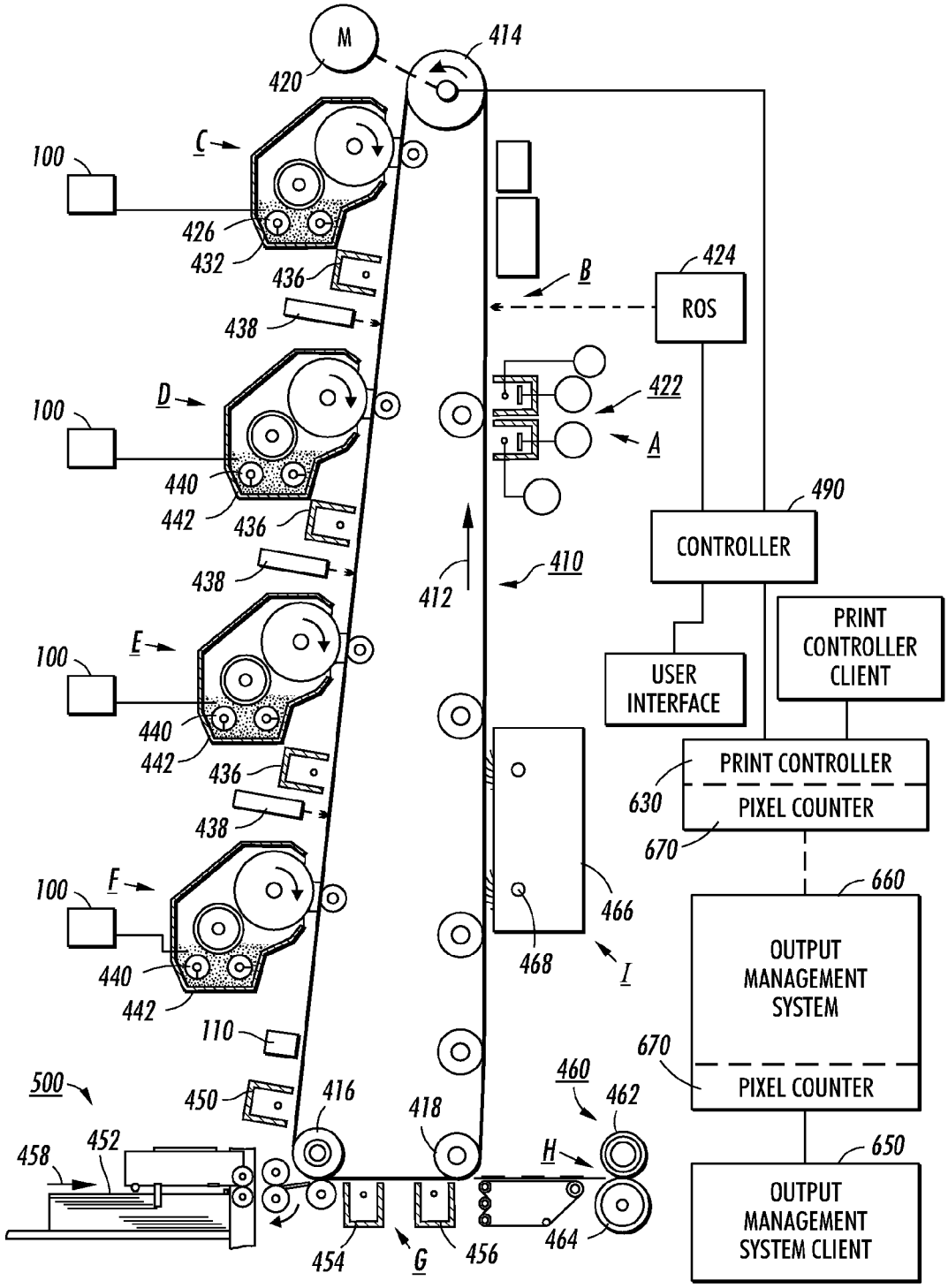
FIG. 1 illustrates a schematic view of a digital imaging system.

While the present invention will be described in connection with preferred embodiments thereof, it will be understood that it is not intended to limit the invention to that embodiment. On the contrary, it is intended to cover all alternatives, modifications and equivalents as may be included within the spirit and scope of the invention as defined by the appended claims.

The embodiments include a method of controlling a speed of a fuser cleaner web in a fuser apparatus, the fuser cleaner web for cleaning a fuser roll and being disposed between the fuser roll and a web nip roll, the fuser cleaner web being unwound from a web supply roll and wound onto a take up roll, the take up roll being driven by a motor. The method includes determining an angular displacement of the motor from a start of the fuser cleaner web being unwound from the web supply roll, and controlling a speed of the motor to maintain a substantially constant fuser cleaner web speed, wherein the speed of the motor is controlled based on the determined angular displacement of the motor and a changing diameter of the take up roll, the changing diameter of the take up roll including a diameter of the fuser cleaner web as it is wound onto the take up roll.

The embodiments further include a fuser apparatus, including a fuser roll, a web nip roll, a fuser cleaner web disposed between the fuser roll and the web nip roll, the fuser cleaner web for cleaning the fuser roll, a web supply roll from which the fuser cleaner web is unwound, a take up roll onto which the fuser cleaner web is wound, a motor driving the take up roll causing the fuser cleaner web to unwind from the web supply roll, move between the fuser roll and the web nip roll, and wind onto the take up roll, and a processor controlling a speed of the motor to maintain a substantially constant fuser cleaner web speed, wherein a speed of the fuser cleaner web is controlled based on an angular displacement of the motor and a changing diameter of the take up roll, the changing diameter of the take up roll including a diameter of the fuser cleaner web as it is wound onto the take up roll.

The embodiments further include a fuser apparatus, including a fuser roll, a web nip roll, a fuser cleaner web disposed between the fuser roll and the web nip roll, a plurality of heat rolls disposed between the fuser roll and the fuser cleaner web, wherein the fuser cleaner web is for indirectly cleaning the fuser roll, a web supply roll from which the fuser cleaner web is unwound, a take up roll onto which the fuser cleaner web is wound, a motor driving the take up roll causing the fuser cleaner web to unwind from the web supply roll, move between the fuser roll and the web nip roll, and wind onto the take up roll, and a processor controlling a speed of the motor to maintain a substantially constant fuser cleaner web speed, wherein a speed of the fuser cleaner web is controlled based on an angular displacement of the motor and a changing diameter of the take up roll, the changing diameter of the take up roll including a diameter of the fuser cleaner web as it is wound onto the take up roll.

In as much as the art of electrophotographic printing is well known, the various processing stations employed in the FIG. 1 printing machine will be shown schematically and their operation described briefly with reference thereto. Various other printing machines could also be used, and this is only an example of a particular printing machine that may be used with the invention.

FIG. 1 is a partial schematic view of a digital imaging system, such as the digital imaging system of U.S. Pat. No. 6,505,832, which is hereby incorporated by reference. The imaging system is used to produce an image such as a color image output in a single pass of a photoreceptor belt. It will be understood, however, that it is not intended to limit the invention to the embodiment disclosed. On the contrary, it is intended to cover all alternatives, modifications and equivalents as may be included within the spirit and scope of the invention as defined by the appended claims, including a multiple pass color process system, a single or multiple pass highlight color system, and a black and white printing system.

Referring to FIG. 1, an Output Management System 660 may supply printing jobs to the Print Controller 630. Printing jobs may be submitted from the Output Management System Client 650 to the Output Management System 660. A pixel counter 670 is incorporated into the Output Management System 660 to count the number of pixels to be imaged with toner on each sheet or page of the job, for each color. The pixel count information is stored in the Output Management System memory. The Output Management System 660 submits job control information, including the pixel count data, and the printing job to the Print Controller 630. Job control information, including the pixel count data, and digital image data are communicated from the Print Controller 630 to the Controller 490.

The printing system preferably uses a charge retentive surface in the form of an Active Matrix (AMAT) photoreceptor belt 410 supported for movement in the direction indicated by arrow 412, for advancing sequentially through the various xerographic process stations. The belt is entrained about a drive roller 414, tension roller 416 and fixed roller 418 and the drive roller 414 is operatively connected to a drive motor 420 for effecting movement of the belt through the xerographic stations. A portion of photoreceptor belt 410 passes through charging station A where a corona generating device, indicated generally by the reference numeral 422, charges the photoconductive surface of photoreceptor belt 410 to a relatively high, substantially uniform, preferably negative potential.

Next, the charged portion of photoconductive surface is advanced through an imaging/exposure station B. At imaging/exposure station B, a controller, indicated generally by reference numeral 490, receives the image signals from Print Controller 630 representing the desired output image and processes these signals to convert them to signals transmitted to a laser based output scanning device, which causes the charge retentive surface to be discharged in accordance with the output from the scanning device. Preferably the scanning device is a laser Raster Output Scanner (ROS) 424. Alternatively, the ROS 424 could be replaced by other xerographic exposure devices such as LED arrays.

The photoreceptor belt 410, which is initially charged to a voltage V0, undergoes dark decay to a level equal to about −500 volts. When exposed at the exposure station B, it is discharged to a level equal to about −50 volts. Thus after exposure, the photoreceptor belt 410 contains a monopolar voltage profile of high and low voltages, the former corresponding to charged areas and the latter corresponding to discharged or developed areas.

At a first development station C, developer structure, indicated generally by the reference numeral 432 utilizing a hybrid development system, the developer roller, better known as the donor roller, is powered by two developer fields (potentials across an air gap). The first field is the AC field which is used for toner cloud generation. The second field is the DC developer field which is used to control the amount of developed toner mass on the photoreceptor belt 410. The toner cloud causes charged toner particles to be attracted to the electrostatic latent image. Appropriate developer biasing is accomplished via a power supply. This type of system is a noncontact type in which only toner particles (black, for 426 example) are attracted to the latent image and there is no mechanical contact between the photoreceptor belt 410 and a toner delivery device to disturb a previously developed, but unfixed, image. A toner concentration sensor 100 senses the toner concentration in the developer structure 432.

The developed but unfixed image is then transported past a second charging device 436 where the photoreceptor belt 410 and previously developed toner image areas are recharged to a predetermined level.

A second exposure/imaging is performed by device 438 which comprises a laser based output structure which is utilized for selectively discharging the photoreceptor belt 410 on toned areas and/or bare areas, pursuant to the image to be developed with the second color toner. At this point, the photoreceptor belt 410 contains toned and untoned areas at relatively high voltage levels, and toned and untoned areas at relatively low voltage levels. These low voltage areas represent image areas which are developed using discharged area development (DAD). To this end, a negatively charged, developer material 440 comprising color toner is employed. The toner, which by way of example may be yellow, is contained in a developer housing structure 442 disposed at a second developer station D and is presented to the latent images on the photoreceptor belt 410 by way of a second developer system. A power supply (not shown) serves to electrically bias the developer structure to a level effective to develop the discharged image areas with negatively charged yellow toner particles. Further, a toner concentration sensor 100 senses the toner concentration in the developer housing structure 442.

The above procedure is repeated for a third image for a third suitable color toner such as magenta (station E) and for a fourth image and suitable color toner such as cyan (station F). The exposure control scheme described below may be utilized for these subsequent imaging steps. In this manner a full color composite toner image is developed on the photoreceptor belt 410. In addition, a mass sensor 110 measures developed mass per unit area. Although only one mass sensor 110 is shown in FIG. 1, there may be more than one mass sensor 110.

To the extent to which some toner charge is totally neutralized, or the polarity reversed, thereby causing the composite image developed on the photoreceptor belt 410 to consist of both positive and negative toner, a negative pre-transfer dicorotron member 450 is provided to condition the toner for effective transfer to a substrate using positive corona discharge.

Subsequent to image development a sheet of support material 452 is moved into contact with the toner images at transfer station G. The sheet of support material 452 is advanced to transfer station G by a sheet feeding apparatus 500, described in detail below. The sheet of support material 452 is then brought into contact with photoconductive surface of photoreceptor belt 410 in a timed sequence so that the toner powder image developed thereon contacts the advancing sheet of support material 452 at transfer station G.

Transfer station G includes a transfer dicorotron 454 which sprays positive ions onto the backside of sheet 452. This attracts the negatively charged toner powder images from the photoreceptor belt 410 to sheet 452. A detack dicorotron 456 is provided for facilitating stripping of the sheets from the photoreceptor belt 410.

After transfer, the sheet of support material 452 continues to move, in the direction of arrow 458, onto a conveyor which advances the sheet to fusing station H. Fusing station H includes a fuser assembly, indicated generally by the reference numeral 460, which permanently affixes the transferred powder image to sheet 452. Preferably, fuser assembly 460 comprises a heated fuser roller 462 and a backup or pressure roller 464. Sheet 452 passes between fuser roller 462 and pressure roller 464 with the toner powder image contacting fuser roller 462. In this manner, the toner powder images are permanently affixed to sheet 452. After fusing, a chute, not shown, guides the advancing sheet 452 to a catch tray, stacker, finisher or other output device (not shown), for subsequent removal from the printing machine by the operator. The fuser assembly 460 may be contained within a cassette, and may include additional elements not shown in this figure, such as an endless fuser belt or endless fuser web (not the fuser cleaner web) around the fuser roller 462. In typical printing machines, this belt or web has been kept relatively short to minimize the size of the fuser assembly or cassette.

After the sheet of support material 452 is separated from photoconductive surface of photoreceptor belt 410, the residual toner particles carried by the non-image areas on the photoconductive surface are removed therefrom. These particles are removed at cleaning station I using a cleaning brush or plural brush structure contained in a housing 466. The cleaning brushes 468 are engaged after the composite toner image is transferred to a sheet.

Controller 490 regulates the various printer functions. The controller 490 is preferably a programmable controller, which controls printer functions hereinbefore described. The controller 490 may provide a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by an operator. Conventional sheet path sensors or switches may be utilized to keep track of the position of the document and the copy sheets.

The foregoing description illustrates the general operation of an electrophotographic printing machine incorporating the fuser apparatus of the present disclosure therein. Not all of the elements discussed in conjunction with FIG. 1 are necessarily needed for effective use of the invention. Instead, these elements are described as a machine within which embodiments of the invention could operate.

Figure 2:
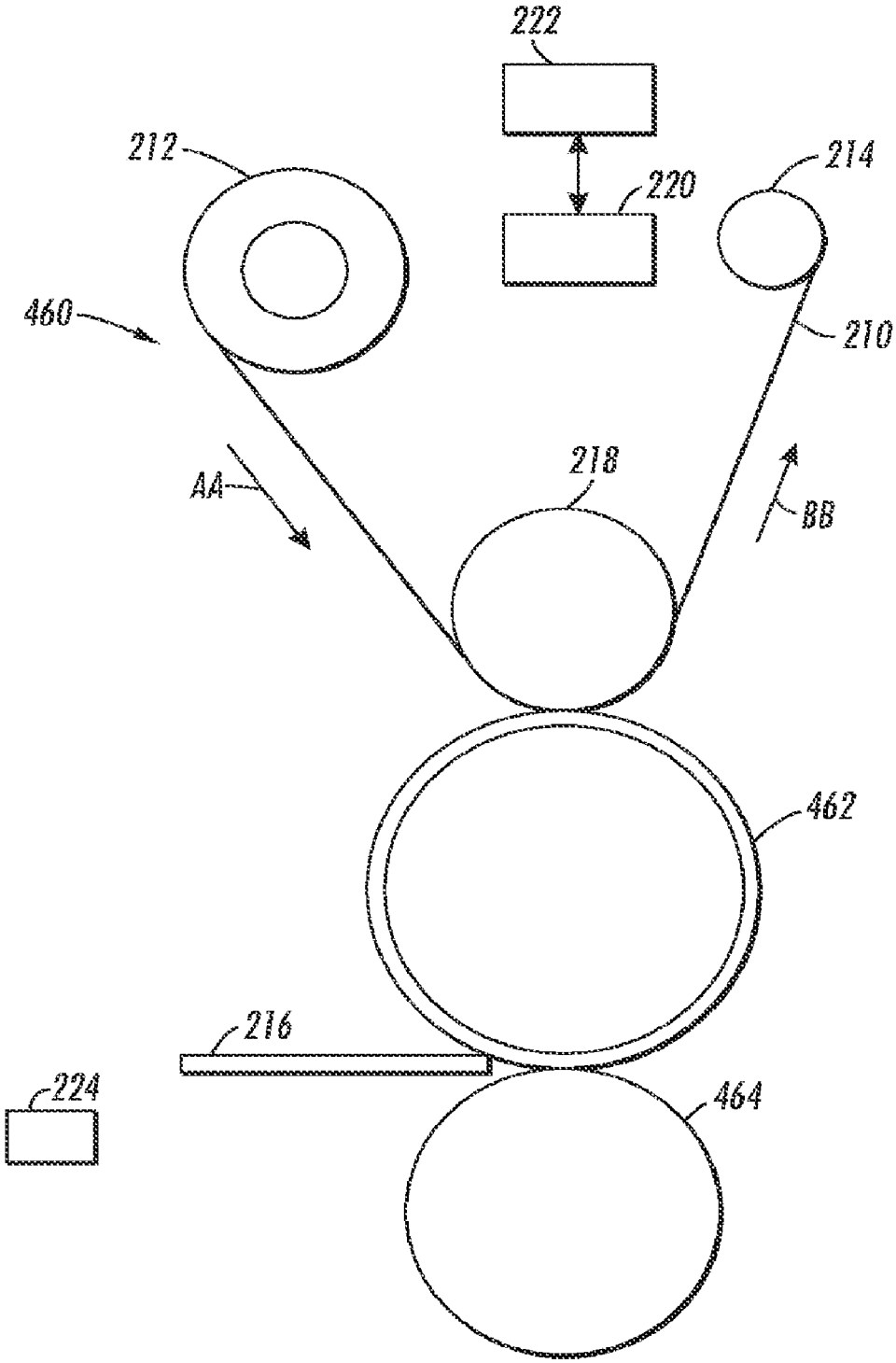
FIG. 2 illustrates a diagram of a fuser assembly.

FIG. 2 illustrates the fuser assembly 460 in greater detail. The fuser assembly 460 includes the fuser roll 462, the pressure roll 464, fuser cleaner web 210, web supply roll 212, web take up roll 214, web nip roll 218, motor 220, controller 222, and sensor 224. The motor 220 may be a motor such as a stepper motor, or synchronous motor, for example, although other types of motors may be used. Furthermore, a transmission, such as a set of gears, and a clutch controlled by the controller 222 could connect the motion of the fuser roll 462 to the web take up roll 214 in a way that would allow the controller 222 to stop and start rotation of the take up roll 214. The motor 220 may drive the take up roll 214, causing the fuser cleaner web 210 to move from the supply roll 212 in the direction of arrow AA, to come into contact with the fuser roll 462, and then to move in the direction of arrow BB onto the take up roll 214.

The speed and other aspects of motor 220 may be controlled by controller 222, which may be any type of controller. The controller 222 may be a part of the fuser assembly 460, although the controller 222 of the fuser assembly 460 could be omitted and another controller, such as controller 490 of FIG. 1, could be used in its place. During the fusing process, media sheet 216 may come into contact with fuser roll 462 to accomplish the fusing process. The controller may have an associated memory for storing data and programs, for example.

The embodiments control a speed of the fuser cleaner web 210 to be substantially constant. For example, the speed of the fuser cleaner web 210 may be controlled to be substantially constant by controlling a speed of the motor 220.

The rotational motor speed is adjusted to achieve a constant linear fuser cleaner web speed. As the fuser cleaner web 210 is wound onto the take up roll 214, the diameter of the take up roll 214 (including the fuser cleaner web wound onto the take up roll 214) increases. Therefore, if a rotational speed of the motor 220 remains constant, a linear speed of the fuser cleaner web 210 will increase as more of the fuser cleaner web 210 is wound onto the take up roll. Accordingly, to maintain a substantially constant linear speed of the fuser cleaner web 210, a rotational speed of the motor 220 must decrease as the fuser cleaner web 210 is wound onto the take up roll 214. By taking into account the diameter of the take up roll 214 (including the fuser cleaner web wound onto the take up roll 214), the motor speed can be adjusted to result in a substantially constant speed of the fuser cleaner web 210.

The rotational speed of the motor 220 and take up roll 214 does not need to be continuous. The speed of the fuser cleaner web 210 is much slower than the speed of the fuser roll so the fuser cleaner web 210 can move for a short time at moderately high speed and then stop for some time and then move forward again for a short time. This duty cycle method of speed control will provide on average a substantially constant fuser cleaner web linear speed while using a constant speed rotational source such as a transmission off the fuser roll motor, or a synchronous motor that can only move at one speed, or low cost motors that only reliably run over a narrow range of speeds. The time of duty cycle on & off periods is about 2 seconds minimum so the motor 220 is sure to start and move to 60 seconds maximum so the fuser cleaner web 210 does not stay still too long. A time to average the motion of the fuser cleaner web over is about 5 minutes.

If a speed of the fusing changes such as when a number of prints per minute of an electrophotographic apparatus is changed, it may be desirable to make a corresponding adjustment in the speed of the fuser cleaner web 210. Accordingly, embodiments may further control a speed of the motor based on a speed of the fuser.

If a gear ratio of gears driving the motor was changed, a corresponding speed of the motor could be changed in embodiments. Accordingly, embodiments may further control a speed of the motor based on a gear ratio of gears between the motor and the take up roll 214.

The controller 222 may monitor aspects including an angular displacement of the motor 220 from a start of the fuser cleaner web 210 being unwound from the web supply roll 212, and control a speed of the motor to maintain a substantially constant speed of the fuser cleaner web 210. Other aspects that may be used to control a speed of the motor 220 include a fusing speed of the fuser and a gear ratio of gears used to drive the take up roll 214 by the motor 220.

The embodiments may control the speed of the motor 220 to maintain a substantially constant speed of the fuser cleaner web 210. The following formulas may be used, where TU=take-up, thk=thickness, Dia=Diameter, { } indicate a note, [ ] indicate units.

The motor speed [displacement/sec]=TU speed [RPM]*Ratio Displacement to TU spool Revolution/60 [sec/min]

TU speed=Web Speed@ Nominal Machine Speed [mm/min]/(TU Dia [mm]*pi)TU Dia [mm]=(core Dia [mm]+TU Revolution*2*web Thk [mm]*(1+Thk Growth))

The motor speed [displacement/sec]=Web Speed@Nominal Machine Speed [mm/min]/((core Dia [mm]+TU Rev*2*Web Thk [mm]*(1+Thk Growth))*pi)*Ratio Displacement to TU spool Revolution/60 [sec/min]

Motor Displacement=TU Revolutions*Ratio Displacement to TU spool revolutions Intercept {at 0 TU revolutions}=1/(motor speed [displacement/sec]=1/Web Speed @Nominal Machine Speed [mm/min]/((core Dia [mm]+0*2*Web Thk [mm]*(1+Thk Growth))*pi))*Ratio Displacement to TU spool Revolutions/60 [sec/min])

Intercept {at 0 TU rev} [sec/displacement]=1/(motor speed [displacement/sec]=Intercept [sec/displacement]=1/Web Speed [mm/min]/(core Dia [mm]*pi)*Ratio of motor Displacement to TU spool Revolutions/60[sec/min])

Slope=rise/run {between 0 and 1 TU revs}=Slope [sec/displacement^2]=(1/Web Speed [mm/min]/((core Dia [mm]+1*2*Web Thk [mm]*(1+Thk Growth))*pi)*Ratio motor Displacement to TU spool Revolutions/60 [sec/min]−Intercept)/(1*Ratio of motor Displacement to TU Spool Revolutions)

Removing the 1's

Slope [sec/displacement^2]=(1/Web Speed [mm/min]/((core Dia [mm]+2*Web Thk [mm]*(1+Thk Growth))*pi)*Ratio motor Displacement to TU spool Revolutions/60 [sec/min]−Intercept)/Ratio of motor Displacement to TU Spool Revolutions Desired Motor Speed=1/(accumulated motor displacement*slope+intercept)

Figure 3:
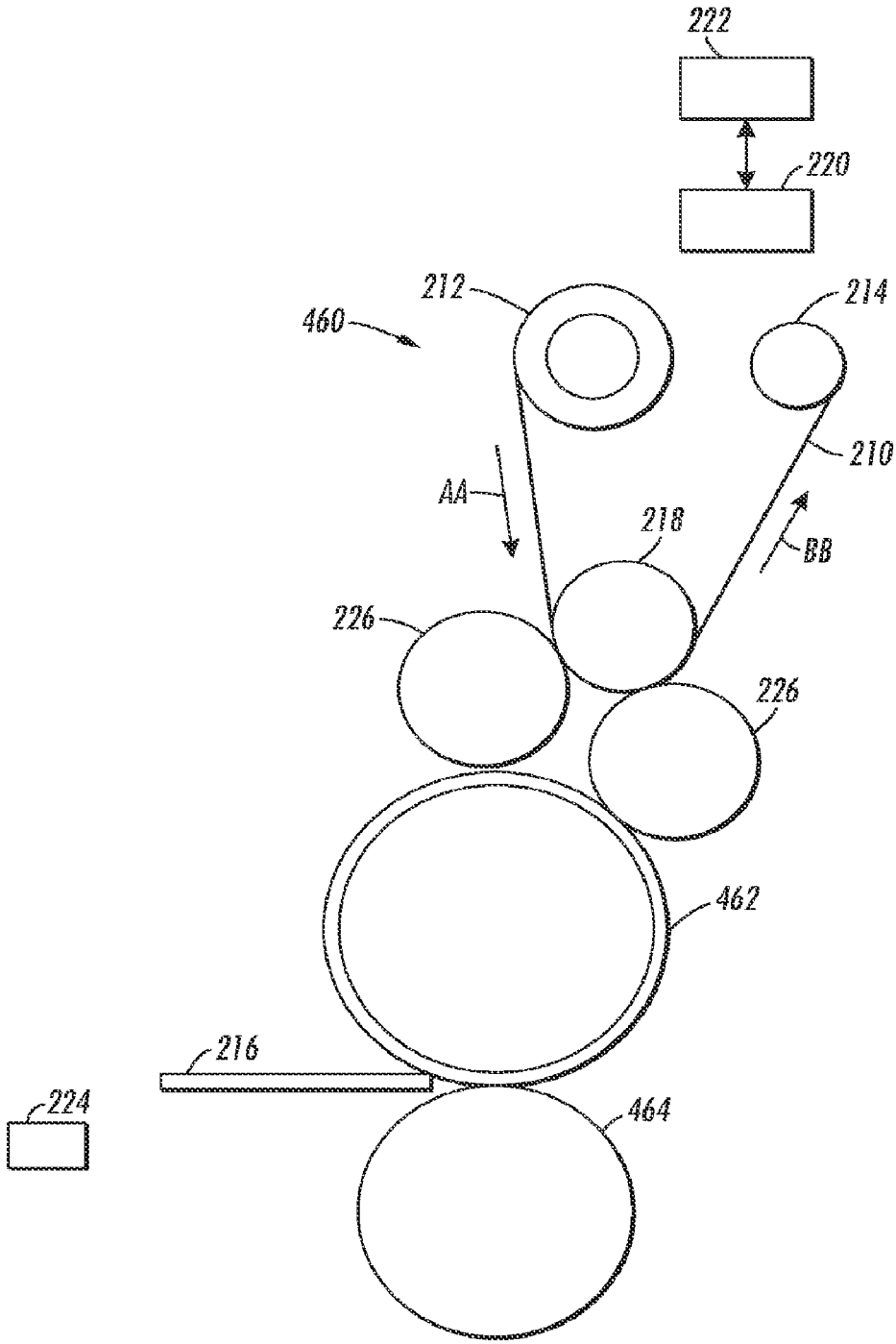
FIG. 3 illustrates a diagram of a fuser assembly.

FIG. 3 illustrates an embodiment of the of the fuser assembly 460 which in addition to the elements of FIG. 2, includes heat rolls 226 disposed between fuser cleaner web 210 and fuser roll 462. This embodiment uses the fuser cleaner web 210 to indirectly clean the fuser roll 462. In particular, the heat rolls 226 clean toner off the fuser roll 462, and the fuser cleaner web 210 then cleans toner from the heat rolls 226. The speed of the fuser cleaner web 210 is controlled in the same manner as the FIG. 2 embodiment, to clean the fuser roll 462. Again, by controlling the speed of the motor 220, the embodiments are able to maintain a substantially constant speed of the fuser cleaner web 210.

The controller 222 may have instructions loaded via a computer readable medium. The embodiments may include computer-readable medium for carrying or having computer-executable instructions or data structures stored thereon. Such computer-readable medium can be any available medium that can be accessed by a general purpose or special purpose computer. By way of example, and not limitation, such computer-readable medium can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hardwired, wireless, or combination thereof) to a computer, the computer properly views the connection as a computer-readable medium. Thus, any such connection is properly termed a computer-readable medium. Combinations of the above should also be included within the scope of the computer-readable medium.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein. The instructions for carrying out the functionality of the disclosed embodiments may be stored on such a computer-readable medium.

Figure 4:
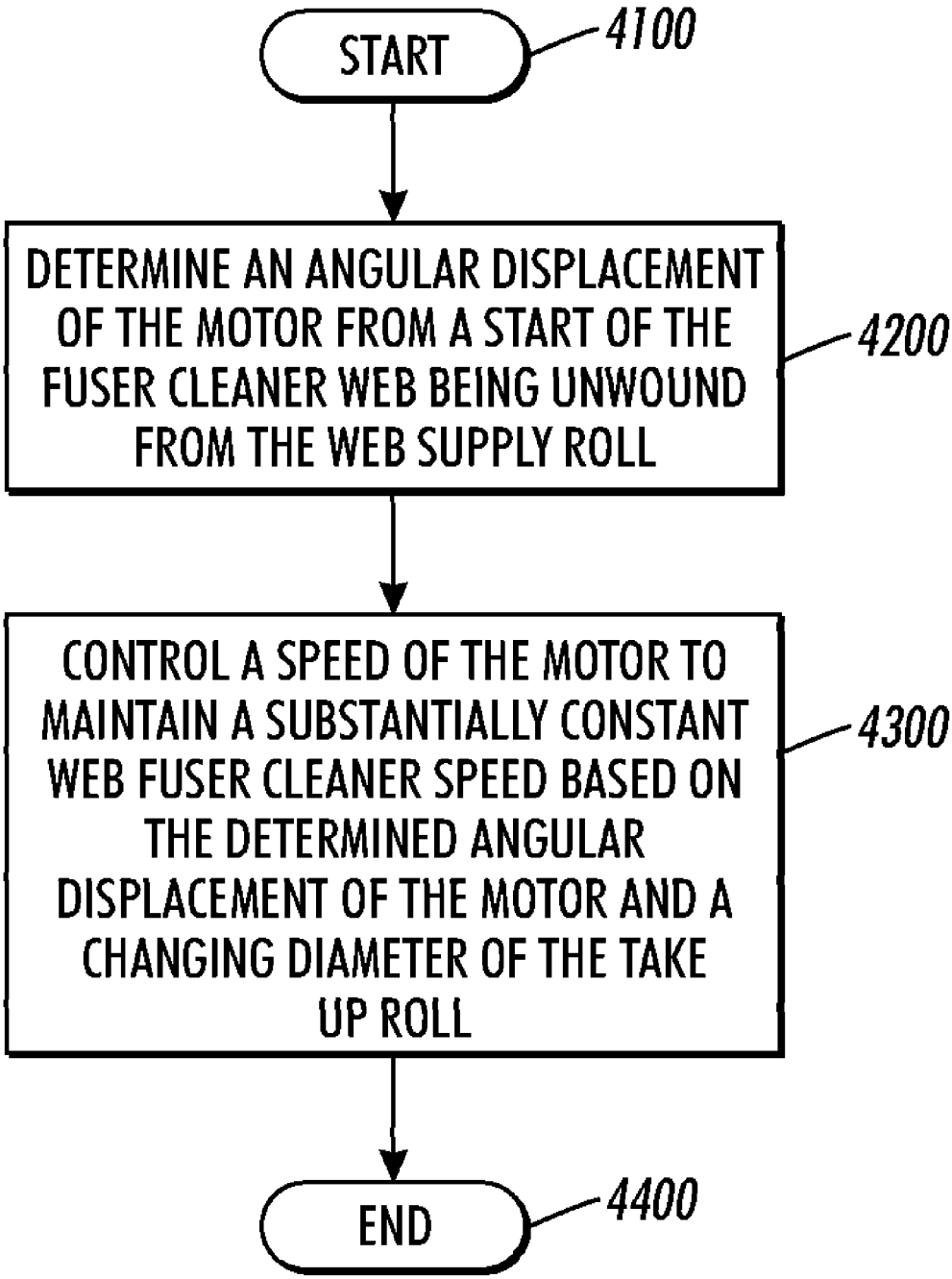
FIG. 4 illustrates a flowchart of a method for controlling a web speed in a fuser apparatus.

FIG. 4 illustrates a flowchart of a method for forming images on sheets in an electrophotographic apparatus. The method starts at 4100. At 4200, an angular displacement of the motor from a start of the fuser cleaner web being unwound from the web supply roll is determined.

At 4300, a speed of the motor 220 is controlled to maintain a substantially constant fuser cleaner web speed, wherein the speed of the motor 220 is controlled to result in a substantially constant fuser cleaner web speed based on the determined angular displacement of the motor 220 and a changing diameter of the take up roll 214, the changing diameter of the take up roll 214 including a diameter of the fuser cleaner web 210 as it is wound onto the take up roll 214. At 4400, the method ends.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method of controlling a speed of a fuser cleaner web in a fuser apparatus, the fuser cleaner web for cleaning a fuser roll and being disposed between the fuser roll and a web nip roll, the fuser cleaner web being unwound from a web supply roll and wound onto a take up roll, the take up roll being driven by a motor, comprising:

determining an angular displacement of the motor from a start of the fuser cleaner web being unwound from the web supply roll; and controlling a speed of the motor to maintain a substantially constant fuser cleaner web speed, wherein the speed of the motor is controlled based on the determined angular displacement of the motor and a changing diameter of the take up roll, the changing diameter of the take up roll including a diameter of the fuser cleaner web as it is wound onto the take up roll, wherein the motor speed is further controlled based at least one of a fusing speed of the fuser roll and a gear ratio of gears driving the motor.

2. The method of claim 1, wherein the motor is a stepper motor and the angular displacement of the motor is determined in motor steps.

3. The method of claim 1, wherein the motor is a synchronous motor and the angular displacement of the motor is determined in motor revolutions.

4. The method of claim 1, wherein the motor is a transmission that drives the fuser roll and the angular displacement of the motor is determined in motor revolutions.

5. The method of claim 1, wherein the speed of the motor is continuously variable.

6. The method of claim 1, wherein the speed of the motor is stepwise variable achieved by modifying a duty cycle of the motor.

7. A fuser apparatus, comprising:

a fuser roll;

a web nip roll;

a fuser cleaner web disposed between the fuser roll and the web nip roll, the fuser cleaner web for cleaning the fuser roll;

a web supply roll from which the fuser cleaner web is unwound;

a take up roll onto which the fuser cleaner web is wound;

a motor driving the take up roll causing the fuser cleaner web to unwind from the web supply roll, move between the fuser roll and the web nip roll, and wind onto the take up roll; and a processor controlling a speed of the motor to maintain a substantially constant fuser cleaner web speed, wherein a speed of the fuser cleaner web is controlled based on an angular displacement of the motor and a changing diameter of the take up roll, the changing diameter of the take up roll including a diameter of the fuser cleaner web as it is wound onto the take up roll, wherein the processor further controls the motor speed based on at least one of a fusing speed of the fuser roll and a gear ratio of gears driving the motor.

8. The fuser apparatus of claim 7, wherein the motor is a stepper motor and the angular displacement of the motor is determined in motor steps.

9. The fuser apparatus of claim 7, wherein the motor is a synchronous motor and the angular displacement of the motor is determined in motor revolutions.

10. The fuser apparatus of claim 7, wherein the motor is a transmission that drives the fuser roll and the angular displacement of the motor is determined in motor revolutions.

11. The fuser apparatus of claim 7, wherein the speed of the motor is continuously variable.

12. The fuser apparatus of claim 7, wherein the speed of the motor is stepwise variable achieved by modifying a duty cycle of the motor.

13. An electrophotographic apparatus comprising the fuser apparatus of claim 7.

14. A fuser apparatus, comprising:

a fuser roll;

a web nip roll;

a fuser cleaner web disposed between the fuser roll and the web nip roll;

a plurality of heat rolls disposed between the fuser roll and the fuser cleaner web, wherein the fuser cleaner web is for indirectly cleaning the fuser roll;

a web supply roll from which the fuser cleaner web is unwound;

a take up roll onto which the fuser cleaner web is wound;

a motor driving the take up roll causing the fuser cleaner web to unwind from the web supply roll, move between the fuser roll and the web nip roll, and wind onto the take up roll; and a processor controlling a speed of the motor to maintain a substantially constant fuser cleaner web speed, wherein a speed of the fuser cleaner web is controlled based on an angular displacement of the motor and a changing diameter of the take up roll, the changing diameter of the take up roll including a diameter of the fuser cleaner web as it is wound onto the take up roll, wherein the processor further controls the motor speed based on at least one of a fusing speed of the fuser roll and a gear ratio of gears driving the motor.

15. The fuser apparatus of claim 14, wherein the motor is a stepper motor and the angular displacement of the motor is determined in motor steps.

16. The fuser apparatus of claim 14, wherein the motor is a synchronous motor and the angular displacement of the motor is determined in motor revolutions.

17. The fuser apparatus of claim 14, wherein the motor is a transmission that drives the fuser roll and the angular displacement of the motor is determined in motor revolutions.

18. The fuser apparatus of claim 14, wherein the speed of the motor is continuously variable.

19. The fuser apparatus of claim 14, wherein the speed of the motor is stepwise variable achieved by modifying a duty cycle of the motor.

20. An electrophotographic apparatus comprising the fuser apparatus of claim 14.

* * * * *